US011812902B2

(12) United States Patent
Fang et al.

(10) Patent No.: US 11,812,902 B2
(45) Date of Patent: Nov. 14, 2023

(54) BATHTUB

(71) Applicant: XIAMEN AXENT CORPORATION LIMITED, Xiamen (CN)

(72) Inventors: Yimin Fang, Xiamen (CN); Jianghui Gao, Xiamen (CN); Dongsheng Yao, Xiamen (CN); Arthur Eisenkrein, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 200 days.

(21) Appl. No.: 17/423,299

(22) PCT Filed: Mar. 7, 2020

(86) PCT No.: PCT/CN2020/078314
§ 371 (c)(1),
(2) Date: Jul. 15, 2021

(87) PCT Pub. No.: WO2020/182084
PCT Pub. Date: Sep. 17, 2020

(65) Prior Publication Data

US 2022/0079389 A1 Mar. 17, 2022

(30) Foreign Application Priority Data

Mar. 8, 2019 (CN) ..... 201910176091.7

(51) Int. Cl.
*A47K 3/022* (2006.01)
*A47K 3/10* (2006.01)
*A61H 39/04* (2006.01)

(52) U.S. Cl.
CPC ..... *A47K 3/022* (2013.01); *A47K 3/10* (2013.01); *A61H 39/04* (2013.01)

(58) Field of Classification Search
CPC . A47K 3/022; A47K 3/10; A47K 3/04; A47K 3/204; A61H 39/04
(Continued)

(56) References Cited

U.S. PATENT DOCUMENTS 2,589,280 A * 3/1952 Ocana ..... A47K 4/00 D23/280.3
3,711,872 A * 1/1973 Jarosinski ..... A47K 3/022 4/604

(Continued)

FOREIGN PATENT DOCUMENTS

CN 2160319 Y 4/1994
CN 1744839 A 3/2006

(Continued)

OTHER PUBLICATIONS

European Patent Office: Extended European Search Report for European Application No. 20769128.8 dated Oct. 13, 2022, 7 pages.

(Continued)

*Primary Examiner* — Huyen D Le
(74) *Attorney, Agent, or Firm* — Schwabe, Williamson & Wyatt, PC

(57) ABSTRACT

A bathtub, including a bathtub body and a cover body provided at the internal bottom surface of the bathtub body, wherein a water passing gap is provided between the cover body and the internal bottom surface of the bathtub body. The bathtub further includes: a water discharging component, wherein the water discharging opening of the water discharging component is covered by the cover body, and water in the bathtub body flows into the water discharging opening via the water passing gap for water discharging; and/or a water inlet component, wherein the water of the (Continued)

water inlet component is covered by the cover body, and water flows from the water inlet into the bathtub body via the water passing gap.

19 Claims, 2 Drawing Sheets

(58) Field of Classification Search
USPC ..... 4/621
See application file for complete search history.

(56) References Cited

U.S. PATENT DOCUMENTS

| | | | | |
|---|---|---|---|---|
| 3,882,553 | A * | 5/1975 | Poiencot | A47K 3/024 4/565.1 |
| 3,900,902 | A | 8/1975 | Jarosinski | |
| 5,459,887 | A * | 10/1995 | Roman | A61H 33/6073 4/574.1 |
| 5,604,940 | A | 2/1997 | Shimizu | |
| 2002/0002736 | A1* | 1/2002 | Apostolo | E03C 1/01 4/444 |
| 2006/0137089 | A1 | 6/2006 | Hatrick-Smith | |
| 2012/0084910 | A1 | 4/2012 | Murphy | |
| 2015/0297037 | A1 | 10/2015 | Eells | |

FOREIGN PATENT DOCUMENTS

| | | | |
|---|---|---|---|
| CN | 101776889 | A | 7/2010 |
| CN | 103054496 | A | 4/2013 |
| CN | 104116449 | A | 10/2014 |
| CN | 105662214 | A | 6/2016 |
| CN | 106725006 | A | 5/2017 |
| CN | 206226766 | U | 6/2017 |
| CN | 206548410 | U | 10/2017 |
| CN | 107595175 | A | 1/2018 |
| CN | 207804561 | U | 9/2018 |
| CN | 109008726 | A | 12/2018 |
| CN | 109124431 | A | 1/2019 |
| CN | 109171515 | A | 1/2019 |
| CN | 109306723 | A | 2/2019 |
| CN | 210077494 | U | 2/2020 |
| JP | H07255626 | A | 10/1995 |
| JP | 2010200980 | A | 9/2010 |
| JP | 2013248080 | A | 12/2013 |

OTHER PUBLICATIONS

The State Intellectual Property Office of People's Republic of China: First Office Action issued in Chinese Application No. 201910176091.7 dated Nov. 19, 2021; 20 pages, including English translation.

The State Intellectual Property Office of People's Republic of China: Second Office Action issued in Chinese Application No. 201910176091.7 dated Apr. 24, 2022; 21 pages, including English translation.

The State Intellectual Property Office of People's Republic of China: Third Office Action issued in Chinese Application No. 201910176091.7 dated Sep. 22, 2022; 19 pages, including English translation.

International Search Report and Written Opinion for PCT/CN2020/078314 dated Apr. 28, 2020, including English translation; 10 pages.

* cited by examiner

BATHTUB

CROSS-REFERENCE TO RELATED APPLICATION

The present application is a national phase entry under 35 U.S.C. § 371 of International Application No. PCT/CN2020/078314, filed Mar. 7, 2020, which designates the United States of America, which claims priority to CN Application No. 201910176091.7, filed Mar. 8, 2019, the entire disclosures of each of these applications are hereby incorporated by reference in their entireties and for all purposes.

FIELD

The present disclosure relates to the technical field of bathtubs, in particular to a bathtub with a simple appearance.

BACKGROUND

The conventional bathtub generally employs a standing faucet to directly pour water into a bathtub body, and a drain valve at the bottom of the bathtub body is opened to drain the water after use. For this reason, the bathtub always has an obvious drain valve at the bottom.

Besides, with the continuous improvement of human life quality, people have increasing requirements on the function of the bathtub, such as the functions of massage and ultrasonic. Therefore, a lot of holes are required to be provided in the inner wall of the bathtub body, so as to mount corresponding nozzles to realize the corresponding functions.

SUMMARY

Technical Problem

Therefore, the pure white bathtub body generally has many accessory components, which make the overall appearance of the bathtub appear complicated.

Solution to the Problem

Technical Solutions

A bathtub is provided according to the present disclosure, which overcomes the shortcomings of the conventional technology described in the background technology.

The bathtub provided according to the present disclosure includes a bathtub body and a cover body provided at an inner bottom face of the bathtub body, a water passing gap is provided between the cover body and the bottom surface of the bathtub body, the bathtub further includes:

- a drainage component, wherein the drainage component has a water outlet port covered by the cover body, and water in the bathtub body flows to the water outlet port through the water passing gap for drainage; and/or
- a water inlet component, wherein the water inlet component has a water inlet port covered by the cover body, and water flows from the water inlet port into the bathtub body through the water passing gap.

Preferably, a surface of the cover body is flat, and is in the same plane as the inner bottom face of the bathtub body.

Preferably, the cover body is located at a center of the inner bottom face of the bathtub, and the water passing gap is formed at an outer circumference of the cover body.

Preferably, the cover body has a shape of a running track, and the water passing gap is of a looped shape surrounding the cover body.

Preferably, a shape of the cover body matches a shape of the inner bottom face of the bathtub body, a size of the cover body is equivalent to a size of the inner bottom face of the bathtub body being reduced in proportion, and an area of the cover body is not less than 10% of an area of the inner bottom face of the bathtub body.

Preferably, a recessed portion having an upward opening is provided at the inner bottom face of the bathtub body, the cover body is located above the recessed portion, and the water outlet port and/or the water inlet port are arranged in the recessed portion.

Preferably, the cover body is detachably connected to the recessed portion, a back face of the cover body is provided with a clamping portion, the recessed portion has a clamping fitting portion cooperating with the clamping portion, and the cover body is fixed to the inner bottom face of the bathtub body through a connection between the clamping portion and the clamping fitting portion.

Preferably, the bathtub further includes a control component for controlling the drainage component and the water inlet component, the drainage component and the water inlet component are communicatively connected to the control component.

Preferably, the bathtub further includes a light component provided below the cover body, light generated by the light component is emitted through the water passing gap, and the light component is communicatively connected to the control component.

Preferably, the bathtub further includes a massage component arranged below the cover body, water and bubbles sprayed by the massage component enter the bathtub body through the water passing gap, and the massage component is communicatively connected to the control component.

Preferably, the bathtub further includes an anti-overflow component arranged in the recessed portion, and the anti-overflow component is covered by the cover body.

Beneficial Effects of the Invention

Beneficial Effects

Compared with the background technology, the technical solutions of the present disclosure has the following advantages:

1. the bathtub performs water inlet and drainage through the water passing gap between the cover body and the inner bottom face of the bathtub body, the entire bathtub does not have obvious water inlet and outlet ports, only the bathtub body and the cover body are visible, and thus the appearance is simple;
2. the control component can control the drainage component and the water inlet component electronically, and the water inlet and drainage of the bathtub can be controlled remotely, thus the bathtub body does not required to be provided with a mechanical component for controlling the water inlet and drainage, and the entire bathtub is simple and elegant;
3. the light generated by the hidden light component is emitted through the water passing gap, water and bubbles sprayed by the hidden massage component enter the bathtub body through the water passing gap, which make full use of the water passing gap, and there is no need to provide slots or holes for the light component and the massage component, and thus the appearance is simple;

4. the anti-overflow component is covered by the cover body, so there is no need to provide an overflow hole in the bathtub body, which further simplifies the appearance;
5. the cover body is fixed on the inner bottom face through the connection between the clamping portion and the clamping fitting portion, and the structure is simple and reliable; and
6. the cover body is located at the center of the inner bottom face of the bathtub body, the water passing gap is formed at the outer circumference of the cover body, and the shape of the cover body is adapted to the inner bottom face of the bathtub body, therefore, the cover body and the bathtub body form an integrated design, and the entire bathtub is simple and has a strong integral visual effect.

BRIEF DESCRIPTION OF THE DRAWINGS

Description of the Drawings

Figure 1:
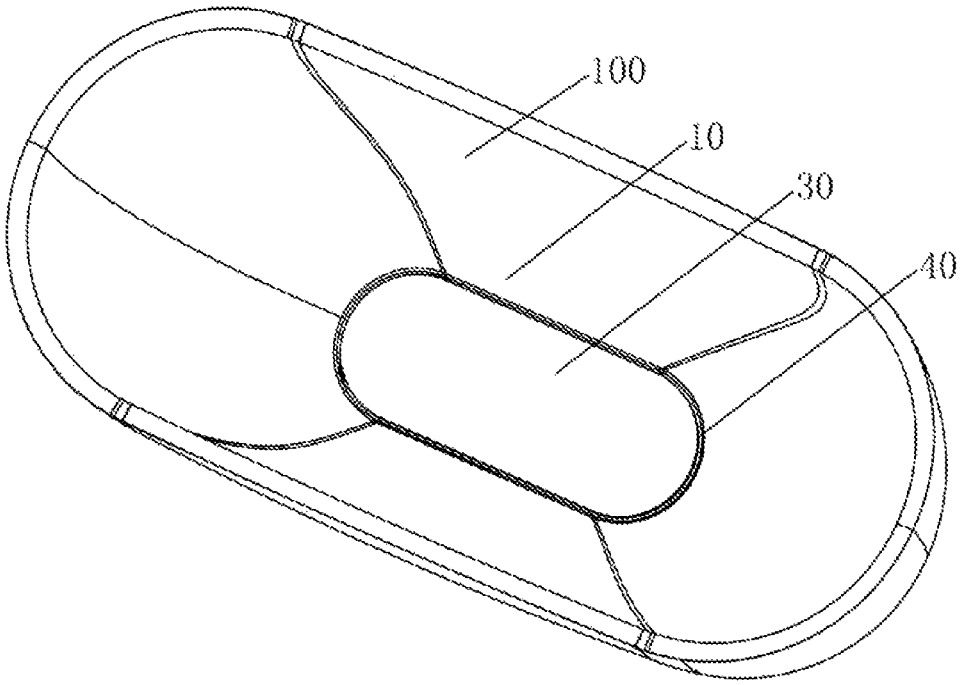
Figure 2:
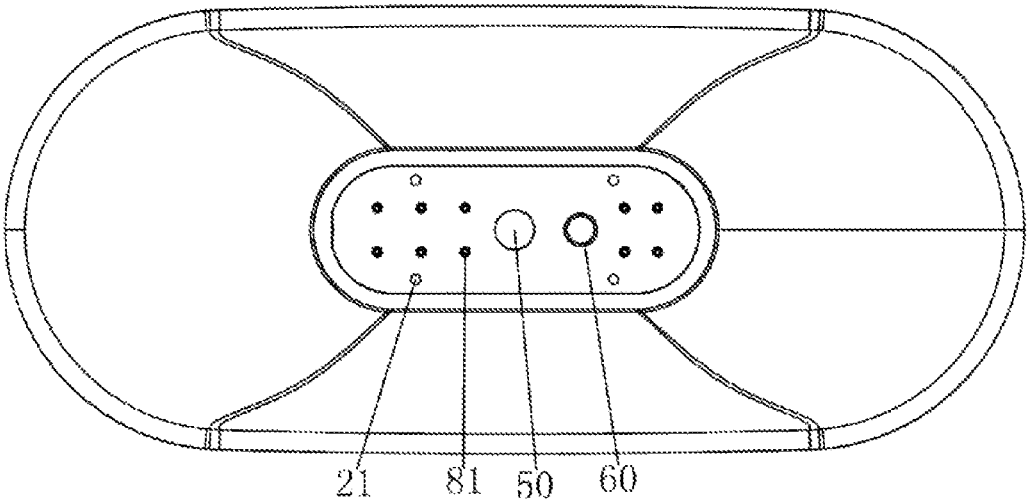
Figure 3:
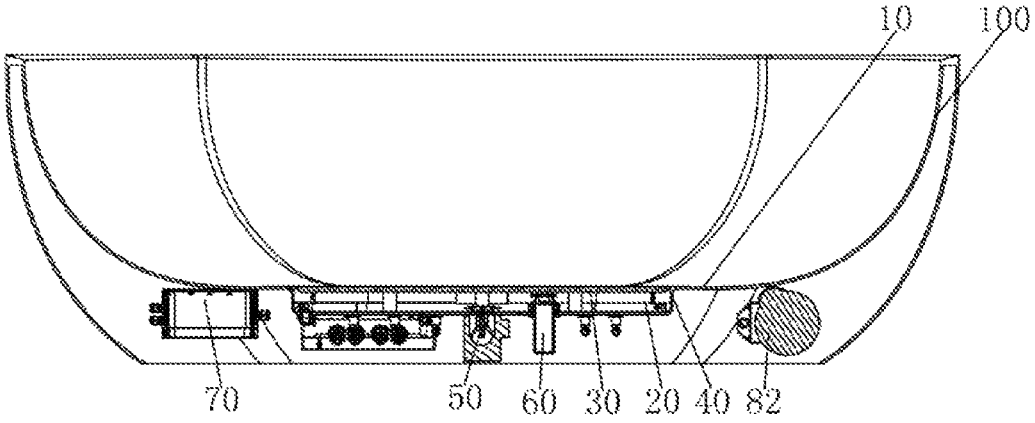
Figure 4:
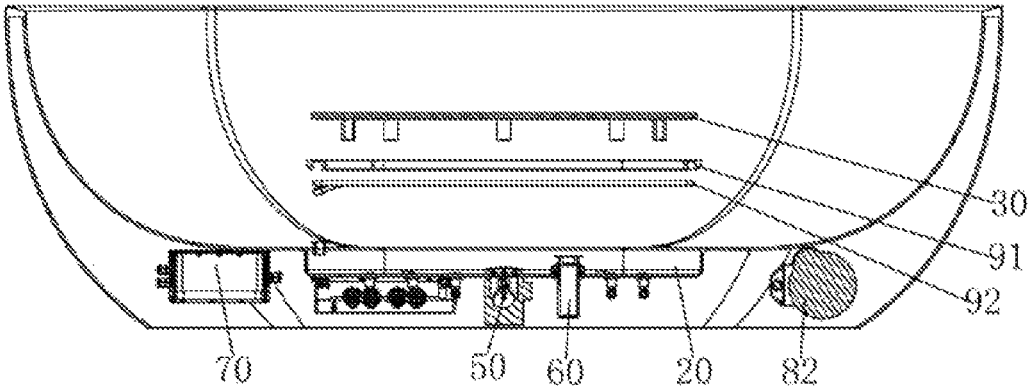
Figure 5:
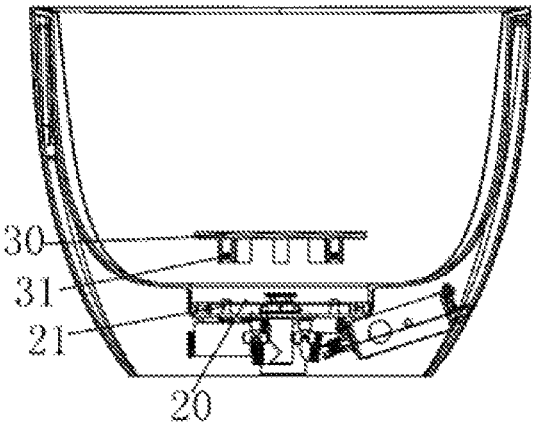

FIG. 1 is a schematic view of an overall appearance of a bathtub according to the present disclosure;

FIG. 2 is a top view of the bathtub according to the present disclosure, where a cover body is removed;

FIG. 3 is a sectional view of the bathtub according to the present disclosure;

FIG. 4 is a sectional view of the bathtub according to the present disclosure, where a part of components are separated; and FIG. 5 is a sectional view of the bathtub according to the present disclosure from another perspective view.

BEST EMBODIMENTS FOR IMPLEMENTING THE INVENTION

Best Embodiments of the Invention

Paragraphs describing the best embodiment of the present disclosure are typed here.

DETAILED DESCRIPTION OF THE EMBODIMENTS

Embodiments of the Invention

The present disclosure will be further described in detail below with reference to the drawings and specific embodiments.

As shown in FIGS. 1 to 5, a bathtub includes a bathtub body 100 having an internal space for accommodating at least one user. An inner bottom face 10 of the bathtub body 100 is provided with a recessed portion 20, and the recessed portion 20 is sunken relative to the inner bottom face 10. A drainage component 50 and a water inlet component 60 are arranged in the recessed portion 20. The bathtub further includes a cover body 30 covering the recessed portion 20, a surface of the cover body 30 is flush with the inner bottom face 10 of the bathtub body, a water passing gap 40 is provided between the cover body 30 and the inner bottom face 10 of the bathtub body, and a water outlet port of the drainage component 50 and a water inlet port of the water inlet component 60 are covered by the cover body 30. When the water is introduced, the water from an external water source enters the recessed portion 20 through the water inlet component 60, and enters the bathtub body through the water passing gap 40; and when the water is required to be discharged, the water in the bathtub body flows out to the recessed portion through the water passing gap, and is then discharged through the drainage component. In a specific embodiment, the entire cover body 30 is located within the inner bottom face of the bathtub body, and the entire cover body and the inner bottom face are in the same plane, the cover body 30 is preferably made of a material having the same color and texture as the bathtub body. Therefore, the cover body and the bathtub body form a whole, and the appearance is simple and harmonious.

The bathtub according to the present disclosure further includes a control component 70 for controlling the drainage component 50 and the water inlet component 60, the drainage component 50 and the water inlet component 60 are communicatively connected to the control component 70. In order to better control the water temperature, the water inlet component 60 includes a thermostatic valve group, and external cold and hot water provided to the bathtub body are mixed via the thermostatic valve group. The user may control the water inlet and outlet, temperature and volume of the water, etc. of the bathtub by operating a remote control, a control panel, or a mobile phone APP which are communicatively connected with the control component.

The bathtub according to the present disclosure further includes an anti-overflow component arranged in the recessed portion, and the anti-overflow component is covered by the cover body. In a specific embodiment, the anti-overflow component is of a hidden-type structure without an overflow port, and is of an integral structure with the water inlet component 60; the above structure is a relatively common technology in the field, and will not be repeated here. Since there is no need to provide an overflow hole in the bathtub body, the overall appearance of the bathtub is further simplified.

The bathtub according to the present disclosure further includes a massage component arranged in the recessed portion, and the massage component is covered by the cover body, water and bubbles sprayed by the massage component enter the bathtub body 100 through the water passing gap 40. The massage component is communicatively connected to the control component 70, such that parameters of the massage component can be controlled through the control component. As shown in FIG. 2, in this embodiment, two sets of nozzles 81 of the massage component are provided on a left side and a right side of the recessed portion 20, respectively, and the water and bubbles sprayed from the nozzles 81 of the massage component enter the bathtub body 100 through the water passing gap 40. The massage component further includes a pump 82 to make the water or air flow.

In this embodiment, as shown in FIG. 5, the cover body 30 is detachably connected with the recessed portion 20, a back face of the cover body 30 is provided with a clamping portion 31, and the recessed portion 20 has a clamping fitting portion 21 cooperating with the clamping portion 31. Specifically, the clamping fitting portion 21 is multiple protruding columns provided in the recessed portion 20, and the clamping portion 31 of the cover body is connected to the convex columns in a clamping manner, so that the cover body 30 is fixed to the inner bottom face 10 of the bathtub body.

Preferably, the cover body 30 is located at a center of the inner bottom face 10 of the entire bathtub, and the water passing gap 40 is formed between an outer circumference of the cover body and a side wall of the recessed portion 20. A shape of the cover body 30 matches a shape of the inner bottom face 10 of the bathtub body, and a size of the shape of the cover body 30 is equivalent to a size of the inner bottom face 10 of the bathtub body being reduced in proportion, and the cover body 30 is placed at the center of the inner bottom face 10 of the bathtub body. For example, in this embodiment, the inner bottom face 10 of the bathtub body has a shape of a running track, the cover body 30 also has a shape of a running track, the inner bottom face 10 of the bathtub body and the cover body 30 have the same center, and the water passing gap 40 is of a looped shape surrounding the cover body 30. Preferably, an area of the cover body 30 is not less than 10% of an area of the inner bottom face 10 of the bathtub body.

The bathtub according to the present disclosure further includes a light component arranged in the recessed portion 20, and the light component is covered by the cover body 30. The light generated by the light component is emitted through the water passing gap, and the light component is communicatively connected to the control component 70. In this embodiment, the light component includes a lamp holder 91 and a lamp band 92 fixed on the lamp holder 91, the lamp holder 91 has a shape matches a shape of the water passing gap 40 and is fixed in the recessed portion 20, and the lamp band 92 surrounds the water passing gap 40, so that the light can be emitted through the water passing gap 40.

In order to make reasonable use of the space, the bathtub body includes a cavity formed between an inner wall and an outer wall of the bathtub body, a part of or all of the control component 70, the water inlet component 60, the drainage component 50 and the pump 82 may be placed in the cavity, and external water and electricity enter the cavity, and are supplied to the corresponding components via the cavity.

Of course, the bathtub body of the bathtub may not be provided with the recessed portion according to the present disclosure, instead, a space may be specifically reserved under the cover body for placing the corresponding components.

The preferred embodiments of the present disclosure are shown and described above. It should be understood that, the present disclosure is not limited to the forms disclosed herein, and should not be regarded as an exclusion of other embodiments, instead, the present disclosure can be used in various other combinations, modifications and environments, and can be modified through the above teaching or technology or knowledge in related fields within the scope of the concept of the present disclosure. The modifications and changes made by those skilled in the art do not depart from the spirit and scope of the present disclosure should fall within the protection scope of the claims of the present disclosure.

INDUSTRIAL APPLICABILITY

The bathtub performs water inlet and drainage through the water passing gap between the cover body and the inner bottom face of the bathtub body, the port are entire bathtub does not have obvious inlet and outlet, only the bathtub body and the cover body are visible, and the appearance is simple.

FREE CONTENT OF SEQUENCE LISTING

Description paragraphs of the free content of the sequence listing are typed here.

The invention claimed is:

1. A bathtub, comprising:

a bathtub body and a cover body provided at an inner bottom face of the bathtub body, wherein a water passing gap is provided between the cover body and the inner bottom face of the bathtub body; and the bathtub further comprises:

a drainage component, wherein the drainage component has a water outlet port covered by the cover body, and water in the bathtub body flows to the water outlet port through the water passing gap for drainage; and/or a water inlet component, wherein the water inlet component has a water inlet port covered by the cover body, and water flows from the water inlet port into the bathtub body through the water passing gap, wherein a recessed portion having an upward opening is provided at the inner bottom face of the bathtub body, the cover body is located above the recessed portion, and the water outlet port and/or the water inlet port are arranged in the recessed portion.

2. The bathtub according to claim 1, wherein the cover body is detachably connected to the recessed portion, a back face of the cover body is provided with a clamping portion, the recessed portion has a clamping fitting portion cooperating with the clamping portion, and the cover body is fixed to the inner bottom face of the bathtub body through a connection between the clamping portion and the clamping fitting portion.

3. The bathtub according to claim 2, wherein the entire cover body is located within a range of the inner bottom face of the bathtub body.

4. The bathtub according to claim 1, further comprising a control component for controlling the drainage component and the water inlet component, wherein the drainage component and the water inlet component are communicatively connected to the control component.

5. The bathtub according to claim 4, wherein the bathtub body has a cavity formed between an inner wall face and an outer wall face of the bathtub body, and the control component, the water inlet component and the drainage component are placed in the cavity.

6. The bathtub according to claim 5, wherein the entire cover body is located within a range of the inner bottom face of the bathtub body.

7. The bathtub according to claim 4, further comprising a light component provided below the cover body, wherein light generated by the light component is emitted through the water passing gap, and the light component is communicatively connected to the control component.

8. The bathtub according to claim 7, wherein the light component comprises a lamp holder and a lamp band fixed on the lamp holder, a shape of the lamp holder matches a shape of the water passing gap, and the lamp band surrounds the water passing gap.

9. The bathtub according to claim 4, further comprising a massage component arranged below the cover body, wherein water and bubbles sprayed by the massage component is introduced into the bathtub body through the water passing gap, and the massage component is communicatively connected to the control component.

10. The bathtub according to claim 1, further comprising an anti-overflow component arranged in the recessed portion, wherein the anti-overflow component is covered by the cover body, and the anti-overflow component and the water inlet component are of an integral structure.

11. The bathtub according to claim 1, wherein a surface of the cover body is flat, and is in the same plane as the inner bottom face of the bathtub body.

12. The bathtub according to claim 11, wherein the entire cover body is located within a range of the inner bottom face of the bathtub body.

13. The bathtub according to claim 1, wherein the cover body is made of a material having the same color and texture as the bathtub body.

14. The bathtub according to claim 1, wherein the entire cover body is located within a range of the inner bottom face of the bathtub body.

15. The bathtub according to claim 14, wherein the cover body is located at a center of the inner bottom face of the bathtub body, and the water passing gap is formed at an outer circumference of the cover body.

16. The bathtub according to claim 15, wherein the inner bottom face and the cover body have the same center, and the water passing gap is of a looped shape surrounding the cover body.

17. The bathtub according to claim 1, wherein a shape of the cover body matches a shape of the inner bottom face of the bathtub body, and the cover body has a shape of a running track.

18. The bathtub according to claim 1, wherein a size of the cover body is equivalent to a size of the inner bottom face of the bathtub body being reduced in proportion.

19. The bathtub according to claim 1, wherein an area of the cover body is not less than 10% of an area of the inner bottom face of the bathtub body.

* * * * *